US008109418B1

(12) United States Patent
Recchia et al.

(10) Patent No.: US 8,109,418 B1
(45) Date of Patent: Feb. 7, 2012

(54) APPARATUS TO ENABLE REMOVAL OF CLOSELY FITTING ATTIRE ON LEGS AND FEET

(76) Inventors: Dennis Recchia, Valencia, CA (US); Janet Shusta-Recchia, Valencia, CA (US)

( * ) Notice: Subject to any disclaimer, the term of this patent is extended or adjusted under 35 U.S.C. 154(b) by 1292 days.

(21) Appl. No.: 11/805,935

(22) Filed: May 25, 2007

(51) Int. Cl.
*A47G 25/80* (2006.01)

(52) U.S. Cl. ..... 223/111

(58) Field of Classification Search ..... 223/111–119
See application file for complete search history.

(56) References Cited

U.S. PATENT DOCUMENTS

| | | | | |
|---|---|---|---|---|
| 881,163 | A | 3/1908 | Spiess | |
| 1,861,385 | A | 5/1932 | Gentil | |
| 2,939,618 | A * | 6/1960 | Mangels | 223/113 |
| 3,396,882 | A | 8/1968 | Berlin | |
| 3,853,252 | A | 12/1974 | Scianimanico | |
| 3,860,156 | A | 1/1975 | Lawrence | |
| 4,238,061 | A | 12/1980 | Marchetti et al. | |
| D259,299 | S | 5/1981 | Vreeken | |
| 4,620,737 | A | 11/1986 | Sanger | |
| 4,638,932 | A | 1/1987 | Keller | |
| 4,943,097 | A | 7/1990 | Sanger | |
| D321,427 | S | 11/1991 | Barrick | |
| 5,687,889 | A | 11/1997 | Liden | |
| 5,924,610 | A | 7/1999 | Willemin | |
| 6,763,982 | B1 | 7/2004 | Livornese | |
| 6,932,252 | B2 | 8/2005 | Simmons | |
| 6,942,129 | B2 | 9/2005 | Ferriaioli | |
| 2004/0069820 | A1 | 4/2004 | Van Loef | |
| 2005/0115994 | A1 | 6/2005 | Delamare | |

FOREIGN PATENT DOCUMENTS

| | | |
|---|---|---|
| GB | 2338172 | 12/1999 |

* cited by examiner

*Primary Examiner* — Shaun R Hurley
*Assistant Examiner* — Andrew Sutton
(74) *Attorney, Agent, or Firm* — Thomas I. Rozsa

(57) ABSTRACT

The present invention is an apparatus to aid in the removal of closely fitting articles on a leg and foot. It includes a helical blade made of a lightweight, rigid, firm substance, having a shoulder area at a proximal end, a bottom area at a distal end which terminates in a bottom edge, a leading edge, and a trailing edge, the blade being arcuate along the plane from the leading edge to the trailing edge so that the blade has a face that is convex and a back that is concave. The apparatus includes a means such as a hook to engage the top of the article to be removed located on the convex face at a location on the bottom area at a given distance from the bottom edge and having a curvation that is facing the bottom edge. The device also includes an integral handle member.

28 Claims, 11 Drawing Sheets

APPARATUS TO ENABLE REMOVAL OF CLOSELY FITTING ATTIRE ON LEGS AND FEET

BACKGROUND OF THE INVENTION

1. Field of the Invention

This invention relates generally to the field of personal aids and is specifically concerned with improvements in an apparatus for the physical removal of objects located on the lower extremities of the body.

2. Description of the Prior Art

The present invention involves the concept of enabling a person to remove objects from his/her body such as socks, closely or tightly fitting leg supports and other items. Unfortunately, many people have difficulty with simple tasks taken for granted, such as removing a sock from their foot. Typically, people who have difficulty taking off their socks generally have trouble bending, are incapable of bending, or lack the strength to remove items from their body, which usually results from physical issues, such as arthritis, paralysis, pregnancy, back and neck problems, weight problems, diabetes, obesity and other health, age and infirmity problems. In addition, people with the above problems often wear leg and foot coverings, including heavy support socks to protect their ankles and to protect their lower legs so that the symptoms of edema or DVT (deep vein thrombosis) will not occur. so that water will not accumulate in their legs. It is also very difficult to remove those types of protective socks or supports. Performance of this task by the physically impaired requires the assistance of another person who may not always be available. The present invention is a unique apparatus which provides additional assistance to facilitate easy removal of an item, such as a sock.

A wide variety of adaptive devices have been devised for the physically impaired. However, in many instances they are useful only under limited conditions.

The following 19 patents and published patent applications are the closest prior art references which are known to the inventors.

1. U.S. Pat. No. 881,163 issued to Gustav Spiess on Mar. 10, 1908 for "Device For Putting On And Taking Off Hose" (hereafter the "Spiess Patent");
2. U.S. Pat. No. 1,861,385 issued to Ignaz Josef Gentil on May 31, 1932 for "Device For Facilitating The Putting On And Taking Off Of Stockings" (hereafter the "Gentil Patent");
3. U.S. Pat. No. 3,396,882 issued to Abe Berlin on Aug. 13, 1968 for "Hosiery-Removal Device" (hereafter the "Berlin Patent");
4. U.S. Pat. No. 3,853,252 issued to Giuseppe M. Scianimanico on Dec. 10, 1974 for "Orthopedic Device" (hereafter the "Scianimanico Patent");
5. U.S. Pat. No. 3,860,156 issued to Frederick R. Lawrence on Jan. 14, 1974 for "Dressing Aid" (hereafter the "Lawrence Patent");
6. U.S. Pat. No. 4,238,061 issued to Luigi Marchetti et al. and assigned to I. B. Internazionale Brevetti on Dec. 9, 1980 for "Socks Or Stockings Wear-Helping Utensil" (hereafter the "Marchetti Patent");
7. U.S. Des. Pat. No. Des. 259,299 issued to Richard Vreeken on May 26, 1981 for "Stocking Removing Tool For the Handicapped Or Similar Article" (hereafter the "Vreeken Design Patent");
8. U.S. Pat. No. 4,620,737 issued to Sampson D. Sanger and assigned to Sanger-Nelken Enterprises on Nov. 4, 1986 for "Manually Operable Personal Convenience Implement" (hereafter the "'737 Sanger Patent");
9. U.S. Pat. No. 4,638,932 issued to Henry C. Keller on Jan. 27, 1987 for "Combination Tool To Pull Up And Remove Socks, Shorts And Trousers" (hereafter the "Keller Patent");
10. U.S. Pat. No. 4,943,097 issued to Sampson D. Sanger and assigned to Yehuda Naim on Jul. 24, 1990 for "Manually Operable Personal Convenience Implement" (hereafter the "'097 Sanger Patent");
11. U.S. Design Pat. No. Des. 321,427 issued to Ford Barrick on Nov. 12, 1991 for "Tool For Donning And Removal Of Hosiery" (hereafter the "Barrick Design Patent");
12. U.S. Pat. No. 5,687,889 issued to Douglas T. Liden on Nov. 18, 1997 for "Multi-Purpose Reacher And Dressing Aid" (hereafter the "Liden Patent");
13. U.S. Pat. No. 5,924,610 issued to Ignance Willemin on Jul. 20, 1999 for "Device To Facilitate Putting On Socks And Similar Articles Of Clothing" (hereafter the "Willemin Patent");
14. U.S. Published patent application No. 2004/069820 issued to Marko J G Van Loef on Apr. 15, 2004 for "Device And Method For Taking Off A Therapeutic Elastic Sock" (hereafter the "Van Loef Published Patent Application");
15. U.S. Pat. No. 6,763,982 issued to George Livornese on Jul. 20, 2004 for "Hosiery Removal And Retrieval Tool With A Notch For Shoe Removal And A Shoehorn" (hereafter the "Livornese Patent");
16. U.S. Published patent application No. 2005/0115994 issued to Michel Delamare on Jun. 2, 2005 for "Device For Putting On And Taking Off A Support Stocking" (hereafter the "Delamare Published Patent Application");
17. U.S. Pat. No. 6,932,252 issued to Henry E. Simmons on Aug. 23, 2005 for "Device To Allow Physically Limited Persons To Put On Or Remove Socks" (hereafter the "Simmons Patent");
18. U.S. Pat. No. 6,942,129 issued to Michael P. Ferraioli on Sep. 13, 2005 for "Footwear Donning Device" (hereafter the "Ferraioli Patent");
19. United Kingdom Patent No. GB 2,338,172 issued to James Charles Skidmore on Dec. 15, 1999 for "Sock Fitting And Removal Appliance" (hereafter the "Skidmore United Kingdom Patent").

The Spiess Patent which issued in 1908 is a device for putting on and taking off hose. To take off the hose. the top of the hose is engaged with the horn c and the adjoining end b of the bow a and the hose therefore, becomes folded up which is then pushed downward on a leg as shown in FIG. 5.

Referring to the Spiess Patent, the preferred embodiment of the device for putting on and taking off hose shown in FIG. 1 appears to show that its primary purpose is the putting on of hose and the removal of hose as a secondary function. To remove hose, one must turn the device around, with the arms of the bow facing away from the body, and pressing the backside of the bow against the flesh of the leg and push downwardly making sure that the horn is outside the hose to catch it as it is being pushed down. It is only by the pressure of the back of the bow against the leg that the Spiess Patent is able to remove the hose. If a patient has sensitive skin, thin skin or easily bruises, the patient will experience pain and discomfort in the removal of anything but loosely fitting articles. Additionally, there is no means to get the hose off from around the heel of the foot. Moreover, the Spiess Patent does not have a hook curving downwardly to aid in the removal of articles, but instead has a horn, pointing upwardly so as to catch and roll up the hose as it is being removed. The Spiess device is incapable of removing items like a tightly fitting sock, a support hose, or a shoe, because the Spiess Patent merely pushes down on an article that must be loosely fitted.

The Gentil Patent which issued in 1932 is another device for facilitating the putting on and taking off socks. The device as illustrated in FIG. 1 consists of an angle shaped bar which is made out of a single piece of material and has a longer limb a and a shorter limb b. The longer limb a consists of a slightly curved part adopted to follow the shape of the sole of the foot and the shorter limb b as a hollowed out part adapted to fit the heel of the foot so that it can be exerted a short distance around each side of the heel of the foot. The Gentil Patent operates by placing the device between the foot and the sock so that the device facilitates putting on and taking off a sock by sliding over the smooth surface of the Gentil device rather than the sole of the foot.

Referring to the Gentil Patent, the preferred embodiment of the device for facilitating the putting on and taking off of stockings shown in FIG. 2 and discussed in lines 75+ of the Gentil Patent, teaches that each device, which fits under the sole of the foot and over the heel, must be placed on the foot before the hose is put on and the sock is, in fact, placed over both the foot and the device. The Gentil Patent further teaches that removal of the device is through the open area at the heel of the sock. To remove the device, the user must bend and contort his leg and body and manipulate the sock so as to remove the device through the heel. To remove the sock, the Gentil device slides under the sole of the foot through the open heel of the sock until the back rests against the user's heel, thereafter, the user bends over and removes the sock. It appears that the Gentil device can only work with articles having no heel, so that the device can be removed after putting the sock on and inserted to take the sock off. It appears that the Gentil device is incapable of properly functioning with any article that has an intact heel. Further, the user of the Gentil device must still bend and contort the user's body to remove the sock. The Gentil device specifically teaches that it aids only to reduce the dragging and pulling required to put on and take off a compression stocking having no heel.

The Berlin Patent which issued in 1968 consists of a hosiery removal device which includes an elongated portion 11 and a handle 12 which terminates in a generally u-shaped plate. The device functions by pushing the generally u-shaped plate against the sock so that the sock will be removed as illustrated in FIG. 3. The plate device is also slightly rounded as shown in FIG. 2 so that it conforms to the back portion of the ankle area and sole of the foot.

Referring to the Berlin Patent, the hosiery removal devices, as shown in FIGS. 1 and 2, appear to show a slender rod, having at one end a handle that is also slender and rod-like and at the other end two metal plates, roughly parallel to each other and is either formed from one piece of metal bent into a u-shape or is two pieces of metal either attached to a third piece of metal transverse to the first two. While the device has the concept of having a member to push downwardly on the upper portion of the sock, it is clearly an awkward and difficult device because the nature of the device is based on a shaft 11, which is a rod at the end of which a force is applied, having a vector extending down the rod to a coupling centered on the tip of the rod. If the hosiery is loosely fitting, removal of the article should not be too difficult, however, if the article is more closely fitting, like support hose, and resists removal, the opposing forces of the support hose at one end of the rod and the downward pressure of force on the handle at the other end of the rod, will cause the rod to torque. The user will be required to exert a lot of force to both overcome the torque action of the shaft and to effectuate removal of the article. Thus, it is difficult for a user of the Berlin Patent to remove the any article that is closely fitting.

The Scianimanico Patent is an orthopedic device which is designed to enable a person to put a sock on. As shown in FIG. 1, there is a lip member which is inserted into the sock and, as shown in FIG. 2, there is a member by which the sock is surrounded so the sock can be pulled onto the person's foot and presumably removed in the same way in the reverse order.

Referring to the Scianimanico Patent, the orthopedic device, as shown in FIG. 1 appears to show that the device requires two hands to operate the device. A set of parallel rods 34 extend from the device in such a manner as to be on either side of the leg. Use of the device with one hand is impossible. It also appears that these rods do not have any support or stabilizing cross bars or brackets. The lack of reinforcement or bracing between the two bars causes these rods float and move independently of each other. Additionally, because these rods are the handles and means by which the device is operated, the device is unstable. It further appears that the u-shaped slide member 12 is fitted to cup the calf of the user and to further nearly wrap the entire leg, as shown in FIG. 3, where the u-shaped member 12 follows a curve approximately 270 degrees as round shaped walls 20 and 22 are followed from edge 24 to edge 25. This device has a limited use for persons whose legs fit within the diameter of the u-shaped member 12. Larger persons, as ⅔ of Americans are, will not be able to utilize this device. Further, to remove the sock, as shown in FIG. 5, the device only provides a lip 30. It appears that the device requires the user to slip the lip 30 between the leg and the sock and push downwardly on the device. As there is no hook or other means to push down on the top of the sock, the user must continue pushing downwardly until the lip 30 catches on the sock, presumably somewhere near the heel, sole or even toe of the sock and to keep pushing until the sock is removed. The user must bend or stoop to extend the device so that the upper portion of the sock can extend past the toes of the foot and thus be fully removed. The longer the sock, the more the user must bend and extend. The device does have a rounded connecting portion 32 that has a contour which extends slightly outward as it closely follows the contour of the outer surface of the slide member 12. However, it is not designed to catch the top of a sock, nor could it have any effect on helping to push down on a tightly fitting support hose or compression sock.

The Lawrence Patent which issued in 1975 is for a dressing aid. It is a multiple tool device for putting on stockings, putting on shoes and taking off socks. Referring to FIG. 3, at a remote or proximal end 14.3 the elongated support 14 is provided with a shoe horn 22, the distally extending end 22.1 of which is cemented into the recessed end 14.3 of the support 14. The proximally extending shoe horn 22 is provided with a customary concave shape for easing one's heel into a shoe. Arising from the convex surface 22.2 of the shoe horn is a generally hook shaped sock remover 24 having approximately hook portion 24.1 and approximately extending end 24.2 having flared edges and an outward concave surface configured to bear against one's lower calf and the heel for removal of the stocking.

Referring to the Lawrence Patent, the preferred embodiment of the dressing aid shown in FIG. 9, appears to show that the device shown in FIGS. 1 and 2 is to be used in pairs and adjoined by transverse brackets 32 and 34 which are held in place by a combination of thumb screws and friction. The Lawrence Patent is a cumbersome device, comprised of a multiplicity of parts. To remove a sock, users of the Lawrence Patent are required to disassemble the device, keeping track of all the loose parts, both the cumbersome and the tiny, flip the elongated supports, turn the support so that the side with all the protrusions are facing the leg, push these against the side of the leg while trying to catch the top of the sock with the hook, and, finally, push downwardly to remove the sock. Further, to put the sock back on, requires the reassembly of all the parts. For users who have other associated ailments, such as physical weakness and arthritis, this device is inconvenient and very strenuous to operate.

The Marchetti Patent which issued in 1980 is a socks or stocking wear-helping utensil. It has a rod with a handle 7 which can be held in either hand and the innovation as best shown in FIG. 2 is to have the shell portion 6 surrounding a sock so the device can be used to pull the sock on or push the sock off.

Referring to the Marchetti Patent, the preferred embodiment of the sock wear-helping utensil, as illustrated in FIG. 1, appears to show the device is a rod with a goose neck handle at the proximal end and the rod is bent at the distal end which is used as a pivot for the rotatable shell 5 portion of the device on which the hosiery is situated for placement on the foot and leg. The Marchetti Patent asserts that sock removal is effected by turning the device upside down, and pushing against the sock with the gooseneck portion of the handle. (Col. 1, lines 62-68). In practice, this means that when utilizing the Marchetti Patent to remove a sock, the user, who has turned the utensil upside down, must now contend with the swinging of the rotatable shell as it pivots freely. Users of this device are typically already impaired in some manner and the swinging pivot of the Marchetti Patent further impairs the ability to remove hosiery from their legs. The Marchetti Patent, being primarily designed for the putting on of hosiery, while capable of hosiery removal, simply is not practical for hosiery removal.

The Vreeken Patent is a design patent which protects the shape or the ornamental beauty of an object. It is described as a stocking removing tool for the handicapped or similar article. It does not disclose how the invention works. It appears to have a member that is inserted into the sock and pushed down at the adjacent end so that the back of the sock can be pushed off. However, again, the removal portion is at the extremity of the rod, rather than in the middle where it is more easy to engage and operate the device, and hence the user will experience the difficulties that accompany the torquation of the rod, as discussed above. Additionally, it appears that because the removal portion is at the extreme end of the device, the removal process must immediately proceed as there is no preliminary engagement means or other means to position the device before removal commences. It further appears from the design that there is no hook member used to engage the top portion of the hosiery, but instead a flat transverse member that due to its lack of curvation is inefficient in sock removal.

The '737 Sanger Patent which issued in 1986 is for a manually operated personal convenience implement. Referring to FIGS. 9 and 10, in order to use this device to remove the sock, the tip 47 of the wedge 24 is inserted between the sock and the leg of the wearer. The wedge 24 may be pointed either way from the leg or towards the leg. The free ends of the arms 20 to 21 are preferably joined at this time. The implement is then pushed downwardly along the rear of the leg and foot removing the sock. The radially outward flag portion 50 on the wedge 24 is useful to prevent the sock from riding over and past the wedge 24.

Referring to the Sanger Patent, the preferred embodiment of the manually operable personal convenience implement is a multi-functional device, much like a swiss army knife. Among its multiple functions, the Sanger Patent claims that it is capable of putting on and "removing shoes, stockings, hose, pantyhose, underwear and trousers as well as grasp small articles such as telephone receivers, light switches and chains, drinking and eating utensils, small jars, boxes, cartons, bags and dispensing tubes, jewelry and other personal items, even to scratch the back." (Col. 2, lines 1-6). The specific process to remove a sock is described as utilizing the tip 47 at the end of the wedge 24 to push the sock down. It does not matter which way the wedge 24 is oriented during this process, as only the tip 47 is engaged with the sock. The Sanger Patent does not have any hook member to engage the top of the sock, but suggests that "the radially-outwardly flared portion 50 on the wedge 24 is useful to prevent the sock from riding over and past the wedge 24." As there is no hook or other means to push down on the top of the sock, the user must first press the tip 24 against his leg and keeping constant pressure, continue pushing downwardly until the tip 24 catches on the sock, presumably somewhere near the heel, sole or even toe of the sock and to keep pushing until the sock is removed. If the user utilizes the Sanger Patent with the wedge facing the leg, then the user must deal with the strong likelihood that sides of the wedge are rubbing against the leg as well. Further, with the wedge in this position, the sock, particularly if it is tightly fitting, will simply run over the edge of the wedge and not be easily or efficiently removed and stretched out of shape. If the user utilizes the Sanger Patent with the wedge facing away from the leg, then the tip must be pressed against the leg the entire length down, causing pain, scratching and bruising. With no hook member, a stiff stocking will overcome the outwardly flared edge of the wedge, causing extreme pressure on the leg of the user and excessive stretching of the sock. It is only by the pressure of the tip of the wedge against the leg of the user that the Sanger Patent is able to remove the hose. If the user has sensitive skin, thin skin, or easily bruises, the user will experience pain and discomfort in the removal of anything but loosely fitting articles. Additionally, the user must bend or stoop to extend the device so that the upper portion of the sock can extend past the toes of the foot and thus be fully removed. The longer the sock, the more the user must bend and extend. The device does have an outwardly-flared portion around the rim of the wedge, but it is not designed to catch the top of a sock, nor could it have any effect on helping to push down on a tightly fitting support hose or compression sock. The Sanger Patent also does not provide any means to remove the hose from around the heel of the foot. Moreover, the Sanger Patent does not have a hook curving downwardly to aid in the removal of articles or to catch or roll the sock. It is apparent that the Sanger Patent is incapable of removing items such as a tightly fitting sock, a support hose, or a shoe, because it merely pushes down, which can only work on articles that are loosely fitted.

The Keller Patent which issued in 1987 is a combination tool to pull up and remove socks, shorts and trousers. As shown in FIG. 5, the intention is to use two of these devices as an extension of each hand to grasp either end of the sock with the tools and either pull it up or push it off the foot. It appears that the Keller Patent requires two hands and further that the hosiery to be removed be loosely fitting, as a pair of the Keller devices would encounter difficulty, if not impossibility, of removing tightly fitting articles. To do so, the Keller Patent requires the use of two hands and those two hands must be able to grasp and must further have the strength to make the gripping pads, which are located on average 20 inches from the handle, (col 4, lines 33-36), slide the operating member 28 down, and then exert enough force to be able to remove, by this extended gripping means only, a tightly fitting sock, like a rubber support hose, that is often quite difficult to remove even when attempted directly with the hands. Most persons who require assistance donning or removing hosiery don't have the strength that is required or the dexterity. It is apparent that it is not easy to remove articles that are loosely fitting or tightly fitting The '097 Sanger Patent is a variation on the previously discussed Sanger Patent which again operates in a similar fashion to remove the sock. Again, the only means to remove a sock is by pressing a small pointy portion of the Sanger Patent against the leg and scraping downwardly against the leg to remove the sock. For the same reasons discussed above, this Sanger Patent is also incapable of removing items like a tightly fitting sock, a support hose, or a shoe, because it merely pushes down, which can only work on articles that are loosely fitted.

The Barrick Patent is a design patent described as a tool for donning and removal of hosiery. It appears to have a generally cylindrical interior section with an end which presumably wraps around the sock to push it off and also to pull it on. While it is unclear as to how this device works, presumably sock removal is effectuated by means of the flange that extends from the right hand side of the design, as shown in FIGS. 1, 2, 5 and 6. It is apparent that, with regard to sock removal, this device will have the same issues and problems as the two Sanger Patents and that this device is capable of injuring the user and incapable of removing tightly fitting articles.

The Liden Patent which issued in 1997 is a multi-purpose reacher and dressing aid. As shown in FIGS. 6 and 8, the device has an end portion around which a sock is wrapped and then is pulled onto the foot as shown. To remove a sock, the device is flipped upside down and the reacher arm 6 is inserted between the sock and the leg, the trigger 5 is pulled to grab the sock and the sock is pulled off the foot. It is a cumbersome device, with many parts and is awkward to use. FIGS. 11 through 13 illustrate that a user must still contend with everything at the opposite end from the reacher arm.

The Willemin Patent which issued in 1997 is a device to facilitate putting on socks and similar articles. It has an assembly circular section, which is best shown in FIG. 4, and is used to retain a sock and pull it on. It also has a hook member on the bottom shown in FIG. 1 as item 23 to be used to push the sock off. The Willemin Patent requires that the hook member be very shallow. It further requires that the removal process rely mostly on a frictional force between the device and the leg. Further, referring to FIG. 2, due to the scissor-like nature of the design of the Willemin Patent, the hook member for removing socks is on arm 2 and is operated from handle 20. This means that the user must somehow manage to control arm 1 with one hand, with two hands, or let arm 1 swing freely while trying to remove a sock. Further, the hook member is at the extremity of a rod. As discussed previously, this will have a torquing effect on the device. It is apparent that this is a cumbersome and awkward device to use to remove a sock that is also not capable of removing tightly fitting hosiery.

The Van Loef Patent is a published application, which was published in 2004. It is a device and method for taking off therapeutic elastic socks. As discussed in paragraph 5, the objective of the invention is to provide a device for taking off a therapeutic elastic sock. For this purpose, the device according to the invention is characterized in that the strip is at least partially flexible in at least the strip's longitudinal direction. The strip of the device is slid downwards at the back of the leg between the leg and the sock until the strip's end comes into the sock's heel. In order to make this possible, the device's strip should be narrow. The device is then pushed forcefully further downwards. By doing this, the sock is taken with it by the strip's free end, as will be elucidated later by means of the figures. Because the strip is flexible in the longitudinal direction, it bends round the heel of the person wearing the sock while pushing the sock off. As shown in the picture the device is pushed into the back of the sock and used to push the sock off as best shown in FIGS. 3 and 4. In a variation shown in FIGS. 5 and 6 there is a semi-circular guide profile that helps guide the device through the sock. It is apparent that there is no means to engage the top of the sock, so a user must rely on the end of the flexible device to remove the sock by pushing it off from somewhere between the heel and the toe, thus deforming and damaging the sock.

The Livornese Patent which issued in 2004 is a hosiery removal and retrieval tool. FIG. 1 illustrates a perspective view of the hosiery removal and retrieval tool 10. The tool 10 is a substantially cylindrical elongated shank having a first end 12A and a second end 12B. The first end 12A terminates in a rounded portion 14 having a notch 14N and also having a substantially cylindrical prong 16 which extends from the shank 12 in proximity to the rounded portion 14 at substantially a 45 degree angle. The notch 14N is used to push a shoe off the foot of a user. The prong 16 is used for pushing socks or stockings off the foot of the user. The user of Livornese Patent experiences all the physical pain and all the awkwardness and difficulty of removing a sock from prong at the end of a rod as discussed in the similar devices in the prior art. It is apparent that Livornese Patent is not properly designed for removal of tightly fitting hosiery.

The Delamare Published Application is a published application which was published in 2005. As shown in FIGS. 1 through 4, it is a complicated device, with a multiplicity of parts, requiring two hands and, once again, removal of a sock is effectuated by means of a rounded tip at the extremity that is pushed into the back of the sock and used to push the sock off. For reasons stated above for devices which remove socks in a similar method, it is apparent that this device is impracticable for tightly fitting hosiery, or for users who have hand-related ailments.

The Simmons Patent, which issued in 2005, is a device to allow physically limited persons to put on or remove socks. It is a device that has two handles and a trough-like member which can be inserted between the foot and the sock to help put the sock on. However, sock removal is accomplished by means of turning this two handled device upside down, engaging the notch in one of the two pivotal handles with the top of article to be removed, and pushing downwardly, while allowing the u-shaped sock caddy and the other pivoting handle to dangle.

The Ferraioli Patent is a footwear donning device which has a rounded member at its tip, which, as seen in FIGS. 7 through 10, is inserted into the sock to help pull the sock up and as shown in FIGS. 4, 15 through 17 to push the sock off. The means to remove a sock is a notch at the end of a rod, which is only effective in removing loosely fitting articles. A tightly fitting hose would present difficulties similar to those discussed above.

The Great Britain Patent Application, published in 1988, is a sock fitting and removal appliance, having a sock removal device 7, comprising a handle with a shaped tongue at one end with a finger 8 which engages the top of the socks. The finger of this device is such that it is a cut portion of the tongue which protrudes outwardly from the side of the tongue. When the finger engages a sock, the upper portion of the sock is likely to snag or be cut through repeated usage or a single use of the device. Additionally, the finger is of a very narrow width and at the end of a rod, which will present the torquing issues when engaging a tightly fitting article.

All of these prior art devices include means to don an article by some means to spread the opening of the hosiery apart, most having clamps or u-shaped frames to spread the sock opening apart, and a few relying on the frictional force of the spread apart frame to hold the sock as it is pulled on. Connecting the clamps and fastening devices of such prior art devices to opposite sides of a hosiery opening can be a time consuming and awkward task, particularly for the infirm. The same is true for those prior art devices which require spreading the force to two hands or splitting the device. Many of the prior art devices also require some dexterity to manipulate the complicated assembly of levers, handles and paired devices; a dexterity that the infirm, arthritic, and handicapped may not have. While much thought has been given to the donning of hosiery, it is apparent that very little thought has been given to its removal.

SUMMARY OF THE INVENTION

This invention relates generally to an apparatus to physically remove objects located on the lower extremities of the body.

The present invention involves the concept of enabling a person to remove objects from his/her lower extremities such as socks, closely or tightly fitting leg supports and other items. Unfortunately, many people have difficulty with simple tasks taken for granted, such as removing a sock from their foot. Typically, people who have difficulty taking off their socks generally have trouble bending, are incapable of bending, or lack the strength to remove items from their body, which usually results from physical issues, such as arthritis, paralysis, pregnancy, back and neck problems, weight problems, diabetes, obesity, and other health, handicap, age and infirmity problems. In addition, people with the above problems often wear leg and foot coverings, including heavy support socks to protect their ankles and to protect their lower legs so that edema or DVT (deep vein thrombosis) will not occur. It is also very difficult for people with the above mentioned problems to remove these types of protective socks or supports, as well as other closely fitting articles. The present invention is a unique apparatus which facilitates easy removal of an article, like a sock, from the leg and foot of a person.

The present invention is an apparatus to enable a person to easily remove shoes, socks, or other closely fitting items from his/her legs and feet. The preferred embodiment of the present invention is an, apparatus of a minor-image pair of devices, each of which is made of a single molded piece that is lightweight, strong, sturdy and smooth and is a rigid blade that is thicker and wider at the top end and thinner and narrower at the bottom area. The convex-concave blade is arcuate along its width and has a curvature that becomes more marked as it progresses along its length to the top end. Further, the convex-concave blade has a torsion of the curve value not equal to zero, thus giving the arcuate blade the additional quality of having a corkscrew appearance, with the top end of the shoulder area and the distal extremity of the bottom area approximately 100 degrees out of variance in respect to each other. The purpose of this is so that each blade may approximate the curvatures of the leg from the outer-front side of the thigh above the knee curving downwardly, backwardly and inwardly to the back of the heel. Looking at the devices from the top down, the device with a negative torsion of the curve value, giving it a left hand twist, is designed for the left leg; the device with a positive torsion of the curve value, giving it a right hand twist, is designed for the right leg. The invention includes a curved appendage located on the outward convex side of the blade towards the bottom area used as a hook member. The invention further includes a hand grip or handle member located towards the top end of the device by which a person may manipulate the device. Another important feature of the present invention is that the user's hand stays at 90 degrees to the hook at a neutral position at a side of a leg. The bottom area of the device is rounded off. Both left and right devices of the apparatus have smooth flowing lines and curves.

Although the present invention is an apparatus with two (2) devices, only one device is used at a time, one for the right leg, the other for the left leg. Using the handle, the user places the device against the calf of the leg tucking the rounded bottom portion between the leg and the article to be removed. Once the bottom of the device is between the article and the leg, the user pushes downwardly on the handle. As the device moves downwards, the hook member catches the top and outside of the article. The further progression of the device, after the hook member catches on the article, results in pushing the article off the foot, from the top down.

The preferred embodiment of the present invention is made of a hard plastic, but can be made of any substance capable of the smoothness, firmness and rigidity required to perform the function, such as polymer, plastic, rubber, wood, or even heavy cardboard. Further, any enhancements, including, but not limited to, a gripping enhancement added to the handle member are contemplated in this invention.

Another important feature of the design of the present invention is the distance from the hook to the bottom of the device which is in a preferred distance range of 2 inches to 6 inches. This distance prevents slipping of the device out of a garment. This is most important on tightly fitting garments such as a compression stocking.

Although the present invention is an apparatus with two devices, one for each leg, the device is designed so that one device can be used for both legs. The preferred embodiment shows two devices, one for the left leg and one for the right leg. The preferred use of each device is generally along the outer side of the left leg and the outer side of the right leg. However, a single device can be used for both legs wherein the device preferably designed for the outer side of the left leg may also be used on the inner side of the right leg.

Similarly, the device preferably designed for the outer side of the right leg may also be used on the inner side of the left leg. Thus a pair of the devices is not a requirement of the present invention.

Alternative embodiments of the invention include having the hook member as a separate element that is physically attached to the blade. Such attachment can be made by various means such as screws, glue, velcro, or other adhesive means Another alternative embodiment of the invention has a handle member that is an open space formed or made into the blade near or about the top end. Another alternative embodiment has the handle member formed by a thickening of the shoulder area such that it has a wedge-like appearance when viewed from an edge of the blade.

OBJECTS AND ADVANTAGES

Accordingly, several objects and advantages of the present invention are listed below.

First, it is an object to provide a hosiery removal apparatus that is lightweight and easy to operate, use and store. The present invention provides all of these features.

Second, it is an object of the invention to provide a hosiery removal apparatus that is a device made from one element having no movable or removable parts. The present invention provides all of these features.

Third, it is an object of the invention to provide a hosiery removal apparatus to have two devices: one that is designed to fit comfortably against the outer shape of the left leg and another that is designed to fit comfortably against the outer shape of the right leg. The present invention provides all of these features.

Fourth, it is an object of the invention to provide a hosiery removal apparatus that has devices that are custom fit for the legs of people of any size. The present invention provides all of these features.

Fifth, it is an object of the invention to provide a hosiery removal apparatus having two devices, wherein each device could be used to perform the removal function on either leg. The device designed for the outer shape of the left leg may be used on the inner right leg. The device designed for the outer shape of the right leg may be used on the inner left leg. The present invention provides all of these features.

Sixth, it is an object of the invention to provide a hosiery removal apparatus that can be operated with one hand. The present invention provides all of these features.

Seventh, it is an object of the invention to provide a hosiery removal apparatus that can be operated by people with limited strength and limited hand articulation. The present invention provides these features.

Eighth, it is an object of the invention to provide a hosiery removal apparatus that does not require any adjustment, sliding, tightening, flipping, or rearranging of parts on the device before use. The present invention provides all of these features.

Ninth, it is an object of the invention to provide a hosiery removal apparatus that does not rely on a frictional force of a small point or portion of the device against the leg of the user to fulfill the removal function of the device. The present invention provides all of these features.

Tenth, it is an object of the invention to provide a hosiery removal apparatus having a primary purpose of removing closely fitting articles. Prior art focuses on the donning of articles and gives little thought to the removal of such articles. The present invention provides this feature.

Eleventh, it is an object of the invention to provide a hosiery removal apparatus which is capable of removing tightly fitting articles. Prior art is capable of removing articles, only if such articles are loosely fitting. The present invention provides this feature.

Twelfth, it is an object of the invention to provide a hosiery removal apparatus which is easy to operate. The present invention is very easy to use.

Thirteenth, it is an object of the invention to provide a hosiery removal apparatus which is inexpensive to manufacture. Prior art devices are complex, with multiple, varied components all requiring varied systems of manufacture. Additionally, prior art that contains a multiplicity of parts, as well as complicated apparatuses disguised as another item, are expensive to manufacture. The present invention eliminates parts in the prior art devices and is easy and inexpensive to manufacture since the main body is only one molded or formed piece.

Fourteenth, it is an object of the invention to provide a hosiery removal apparatus which is inexpensive to purchase. Due to the size, simplicity and uncomplicated nature of the present invention, the present invention will be inexpensive to purchase.

Fifteenth, it is an object of the invention to provide a hosiery removal apparatus which is durable. Prior art devices which are made out of metal, thin plastic, flexing materials, and have moveable parts, are fragile and will not last as long as a single, relatively thick piece of resin or polymer that has no moving parts, no moveable parts, and preferably, no removable parts. The present invention is durable.

Sixteenth, it is an object of the invention to provide a hosiery removal apparatus which is compact and easily portable. Prior art devices are generally made from multiple pieces and need to be disassembled prior to storage and again reassembled prior to use.

Portability offers the advantage of flexibility and ease of storage and use. The present invention is compact and easily portable.

Seventeenth, it is an object of the invention to provide a hosiery removal apparatus which is marketable. With the rise in the obesity, health related infirmities, and the growing population of seniors, the home care and medical aid market has skyrocketed. Patients and the infirm have become very active in obtaining personal aids to assist in their daily lives. Doctors are prescribing more home aids and HMO's and patients are looking for affordable and inexpensive devices that can effectively and cost efficiently do the job. The present invention easily lends itself to home care and medical aid markets. Marketing slogans and packaging directed at doctors, HMO's, hospitals, the infirm, family, extended family, and friends about the ease of use and low impact on finances would be very effective and salable. Additionally, there is an endless market for the present invention, as people continue to have problems flexing their bodies for numerous reasons and causes. The present invention is salable, marketable and has an endless, non-seasonable market.

Eighteenth, it is an object of the invention to provide a hosiery removal apparatus which is aesthetically pleasing. The present invention has smooth, flowing lines and interesting curves, twists and shapes. The design of the present invention is a sculpture, almost an object d'art. The present invention is an aesthetic article.

Nineteenth, it is an object of the invention to provide a hosiery removal apparatus which is novel. While other patents for hosiery removal exist, the present invention device has several novel features, one of which is the single unitary element that is the whole of the device. Another novel feature is the placement of the means to engage the top of the hose away from the extremity of the bottom of the device. Another novel feature is the two completely different designs of the curves on the opposite sides along the length of the device. Another novel feature is comfort fitting of the device for the leg. Another novel feature is that the arcuate nature of the device is such that it can fit the leg of a person of any size. The present invention is unique and novel over other devices.

Twentieth, it is an object of the invention to provide a hosiery removal apparatus that is appealing and desirable so that someone who sees one demonstrated by another person will want one too. Patients and relatives of patients may use the device or lend the device to others, or discuss the advantages of the device with others. Those others may want such a device for themselves or their friends or family whom they know could, use the help. The aesthetic quality, low cost and the ease of use improve the desirability of the present invention. The present invention is appealing and desirable.

Twenty-first, it is an object to provide a hosiery removal apparatus which is reliable, reusable, operable, of good quality and useful. The use of the invention makes the user self-sufficient. The apparatus is high quality but inexpensive. It is easy to operate and can be used again and again.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
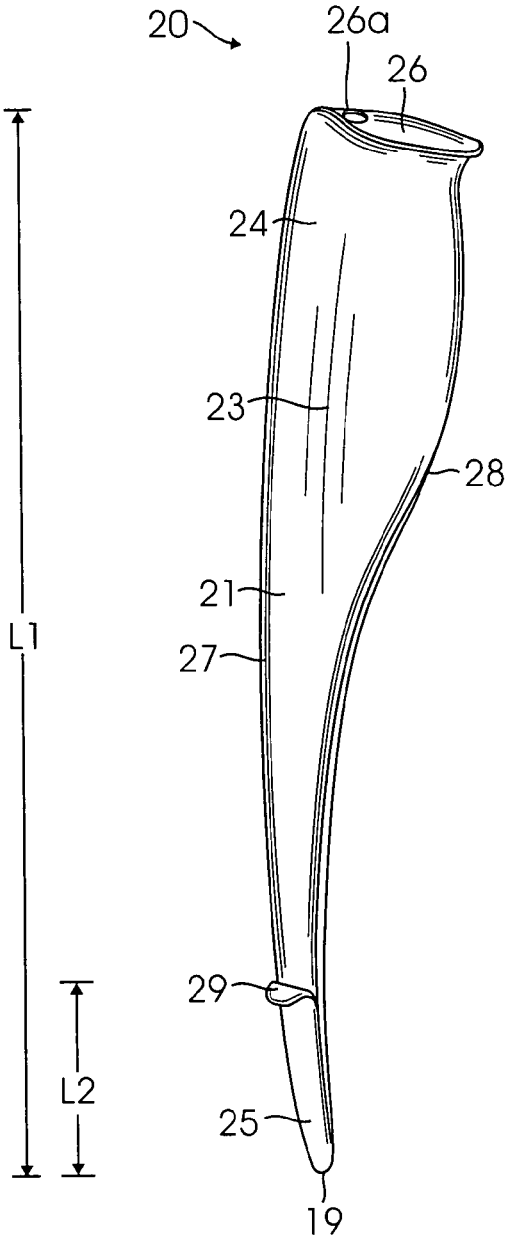
FIG. 1 is an elevational view of an outward face of a right-handed embodiment of the present invention.
Figure 2:
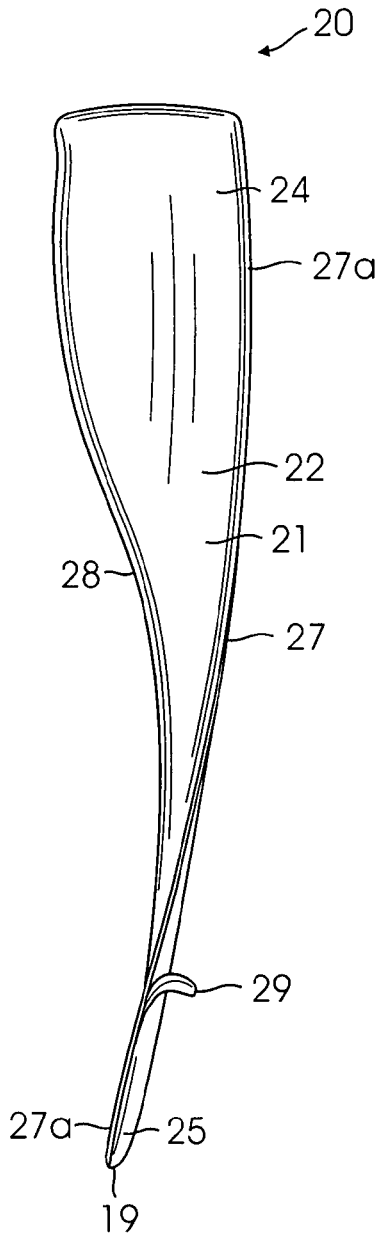
FIG. 2 is an elevational view of an inward face of a right-handed embodiment of the present invention.

While it may take various configurations, the present invention is preferably an apparatus of a pair of devices 20 and 30 which are mirror image of each other and designed for use on the right and left legs respectively. Each device tapers both in width, from 10-11 mm wide at the shoulder areas 24, 34 to 4.5-5 mm at the bottom ends 25, 35, and in thickness from approximately 5 mm at the shoulder areas 24, 34 to 4 mm thick at the bottom ends 25, 35. Referring to FIG. 1, there is illustrated an elevational view of an outward face 23 of a right-handed embodiment 20 of the present invention. While each device may take various configurations, the device for the right leg 20 comprises a preferably shaped helical, tapered blade 21, the width of which is curved into a convex-concave formation, which formation becomes more marked towards the shoulder area 24, made from a firm, polymer material, having a handle member 26 at or around the shoulder area 24, and on which resides a hook member 29 at or around the bottom area 25 on the convex face 23 of the blade 21. The downward curve of the hook member 29 is an important feature of the present invention. The bottom area 25 terminates in a bottom end 19 which preferably is generally rounded so that the blade will not damage objects being removed from the leg and foot.

The device 20 has a given length L1 which by way of example can be approximately 30 inches. In a preferred embodiment, hook member 29 emerges smoothly from the bottom area 25 as it rises into the curve of the hook member 29, the curvation of which is basally outward facing. It is also preferred that hook member 29 is located on or around the bottom area 25 in such a manner that there is a length L2 of bottom areab 25 below hook member 29 sufficient to tuck between the article and the leg in the initial stage of article removal. Preferably, the length L2 of the curvature portion of the hook 29 can be between 10 percent and 25 percent of the total length L1. The preferred distance for L2 is in the range of approximately 2 inches to 6 inches.

The device has a leading edge 27 and a trailing edge 28. While the entire device for the right leg 20 has a generally right-hand, corkscrew or helical twist, the trailing edge 28 has more curvature than the leading edge 27. Further, the upper trailing edge 28*a* has more curvature than the lower trailing edge 28*b*. The twist for the leading edge 27 of the device for the right leg 20, as viewed in FIG. , follows the leading edge 27 along the side of the concave back 22 of the blade 21 from the shoulder area 24 to the bottom area 25. The shoulder area 24 is shown with the concave back 22 facing up. As the device for the right leg 20 makes the right hand twist, the bottom area 25 is turned such that the convex back 23 of the bottom area 25 is mostly shown. This view shows the gentle curve of the leading edge 27 from the upper leading edge 27*a* at the shoulder area 24 to the lower leading edge 27*b* at the bottom area 25.

Figure 3:
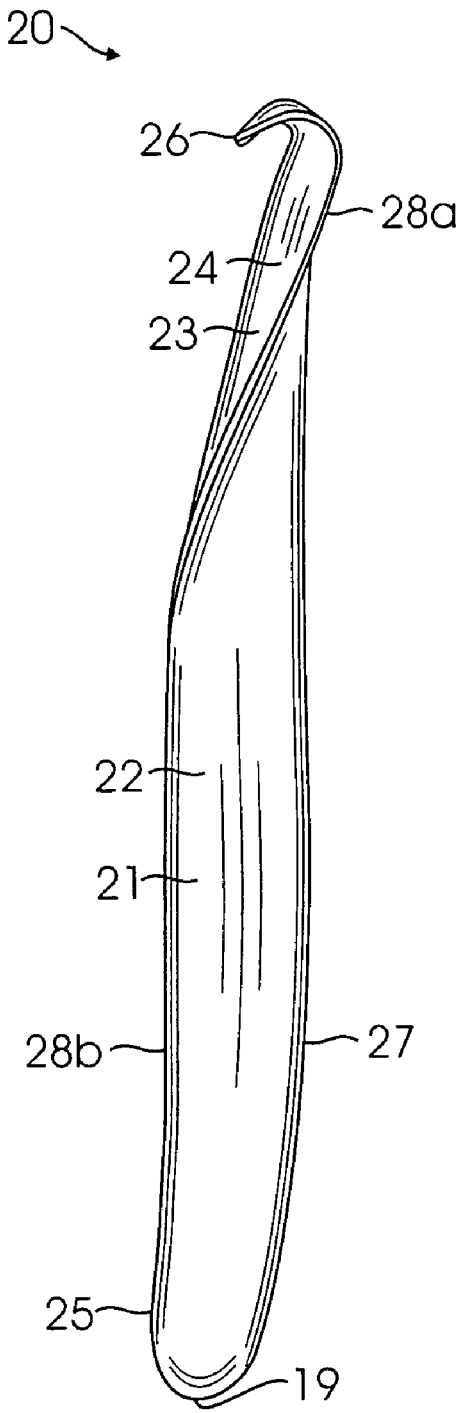
FIG. 3 is an elevational view of a right-handed embodiment of the present invention showing the bottom area fully from the inward side and the handle from the side and further illustrating the twist in the present invention from the inward side at the bottom area to the outward side at the shoulder area.

Referring to FIG. 3, the twist is illustrated on the device for the right leg 20 by showing the entire elevation of the bottom area 25 with the concave back 22 facing the viewer and highlighting the twist along the trailing edge 28. The upper trailing edge 28*a* of the device 20 at the shoulder area 24 is twisted such that part of the convex face 23 is also shown. It can be seen that the direction of the curve is right-handed and that the nature of the bend on the trailing edge 28 is rather sharp, which, as can be approximated from FIG. 3, has a torsion with rotation more than 90 degrees.

Figure 4:
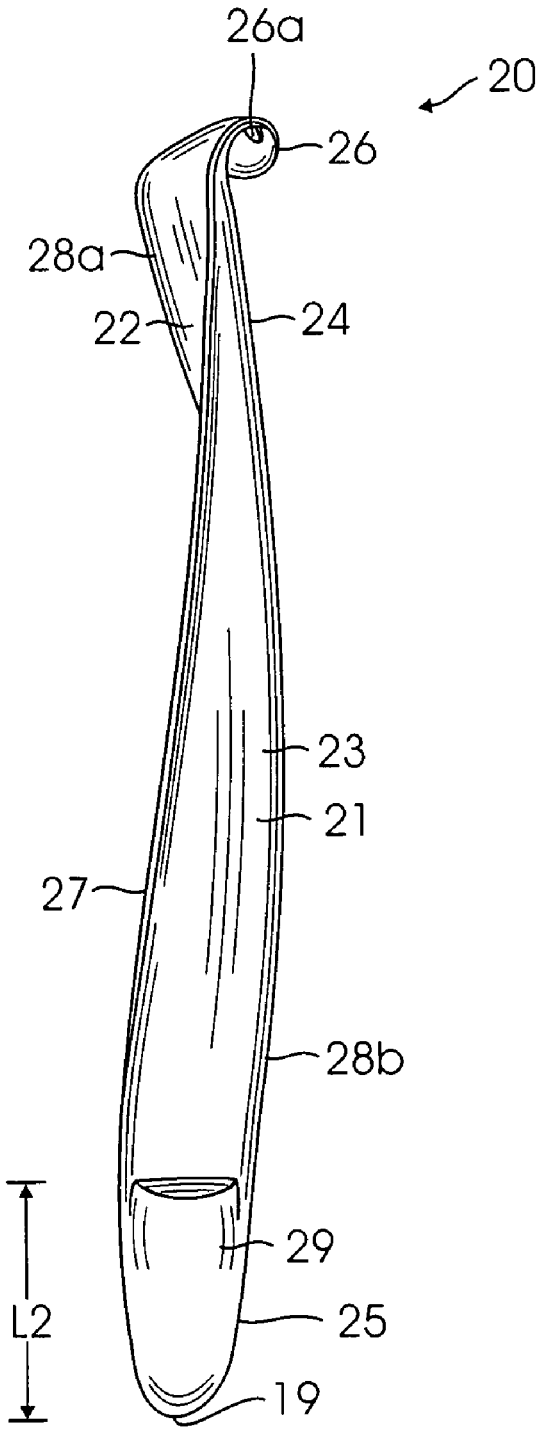
FIG. 4 is an elevational view of a right-handed embodiment of the present invention showing the bottom area fully from the outward side and the handle from the side opposite that shown in FIG. 3, and illustrating the twist in the present invention from the outward side at the bottom area to the inward side at the shoulder area.

Referring to FIG. 4, there is illustrated for device for the right leg 20 the opposing view of that shown in FIG. 3. Here, the entire elevation of the bottom area 25 is shown in such a manner that the convex face 23 at the bottom area 25 is facing the viewer. The hook member 29 is located at the bottom area 25 of the blade 21. The curve along the leading edge 27 is highlighted. As the curve progresses from the bottom area 25 to the shoulder area 24, it shows the curve along the leading edge 27 from the lower leading edge 27*b* to the upper leading edge 27*a*. The twist along the leading edge 27 is enough to allow the concave back 22 to show at the shoulder area 24 of the blade 21. It can also be seen that the direction of the curve is right-handed and that the nature of the bend on the leading edge 27 is not very sharp and has a torsion with rotation approximately 90 degrees.

A comparison of the curves of the trailing edge 28 and the leading edge 27, as shown in FIG. 3 and FIG. 4 respectively, illustrates that the blade 21 has a curve that is generally right-handed. The translation of the leading edge 27 and the trailing edge 28 of the helical curve of the blade 21 is not symmetrical and, individually, neither edge is invariant, although the leading edge 27 is close to being invariant.

Figure 5:
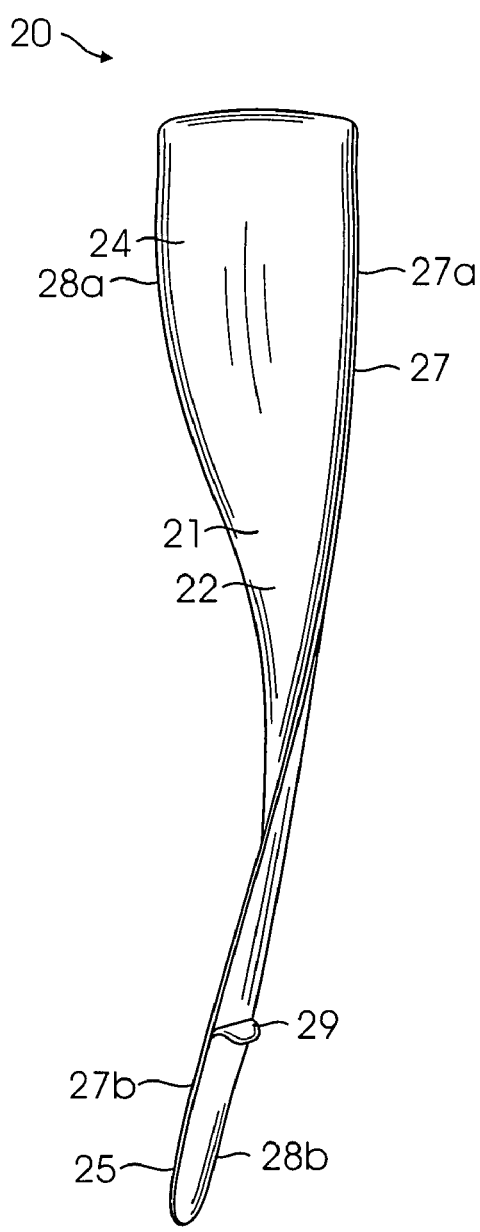
FIG. 5 is an elevational view of a right-handed embodiment of the present invention showing the shoulder area fully from the inward side and the bottom area from the outward side.
Figure 6:
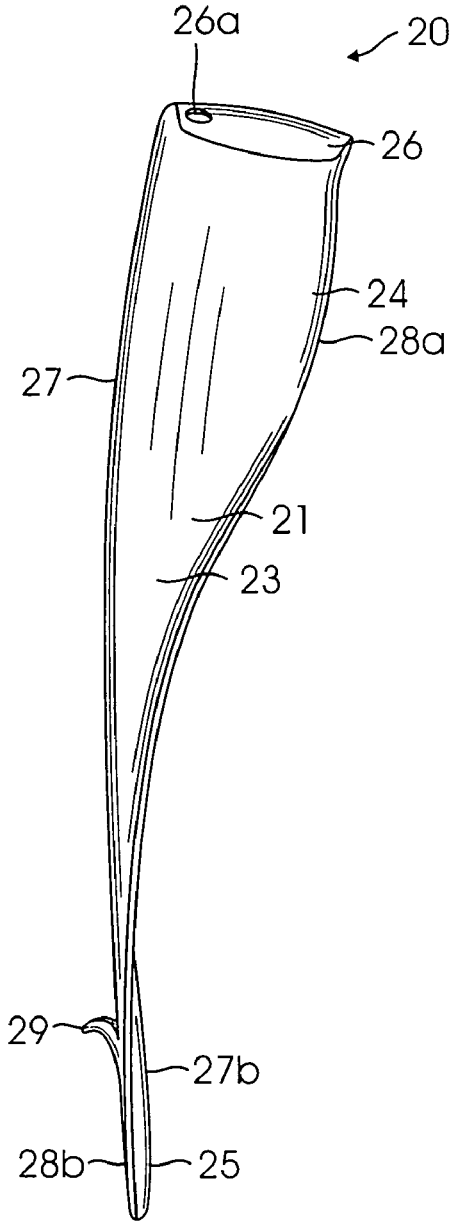
FIG. 6 is an elevational view of a right-handed embodiment of the present invention showing the shoulder area fully from the outward side and the bottom area from the inward side.

Referring to FIG. 5 and FIG. 6, there is illustrated the device for the right leg 20 such that the shoulder area 24 is resting flat. FIG. 5 shows the device 20 with the shoulder area 24 of the concave back 22 fully facing the viewer, and FIG. 6 shows the device 20 with the shoulder area 24 of the convex face 23 fully facing the viewer. In FIG. 5, it can be seen that the lower leading edge 27*b* is turned approximately 90 degrees from the far end of the upper leading edge 27*a*. It can also be seen in FIG. 6, that the lower trailing edge 27*b* is turned more than 90 degrees from the far end of the upper trailing edge 27*b*.

Figure 7:
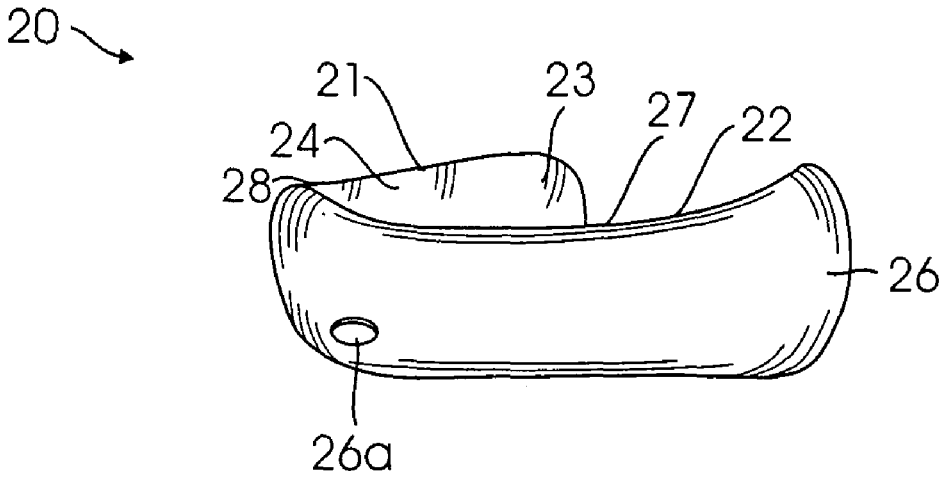
FIG. 7 is a top plan view of a right-handed embodiment of the present invention.

Referring to FIG. 7, there is illustrated the device for the right leg 20 from a top plan view showing the top of the handle 26 in the and the shoulder area 24 of the convex face 23 of the blade 21. The trailing edge 28 is shown rising from the upper left and curving over the handle member 26. The leading edge 27 is shown as it follows its course from the lower right of the handle member 26 to the bottom area 25 of the blade 21. FIG. 7 helps to illustrate the convexity of the face 23 and the concavity of the back 22 by showing the rise and fall of the convexity of the face 23 of the blade 21.

Figure 8:
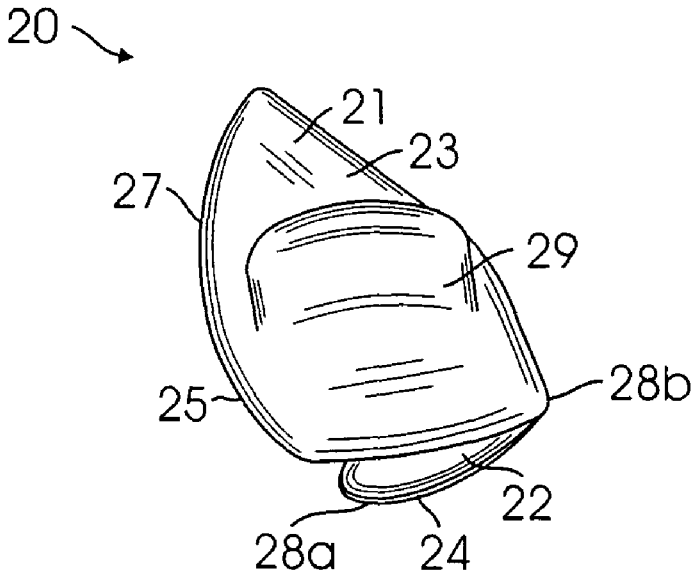
FIG. 8 is a bottom plan view of a right-handed embodiment of the present invention.

Referring to FIG. 8, there is illustrated a bottom plan view of the present invention looking directly into the curvation of the hook member 29 on the convex face 23 of the blade 21. To the left of the hook member 29, the leading edge 27 rises and curves from the bottom area 25 and disappears from sight around the shoulder area 24. The shoulder area 24 is seen from the concave back 22 side of the blade 21 from the side of the trailing edge 28 which, in FIG. 8, begins at and extends along the right side of the bottom area 25, disappears from view for a short stretch and is then shown as it continues to its conclusion at the upper end of the shoulder area 24.

As an optional feature, the device 20 can incorporate a means 26*a* by which the device can be retained on a surface such as a wall or door. By way of example, the device can be an opening 26*a* which can receive a cord or strap which can be hung on a nail or hook in a wall or door.

Figure 9:
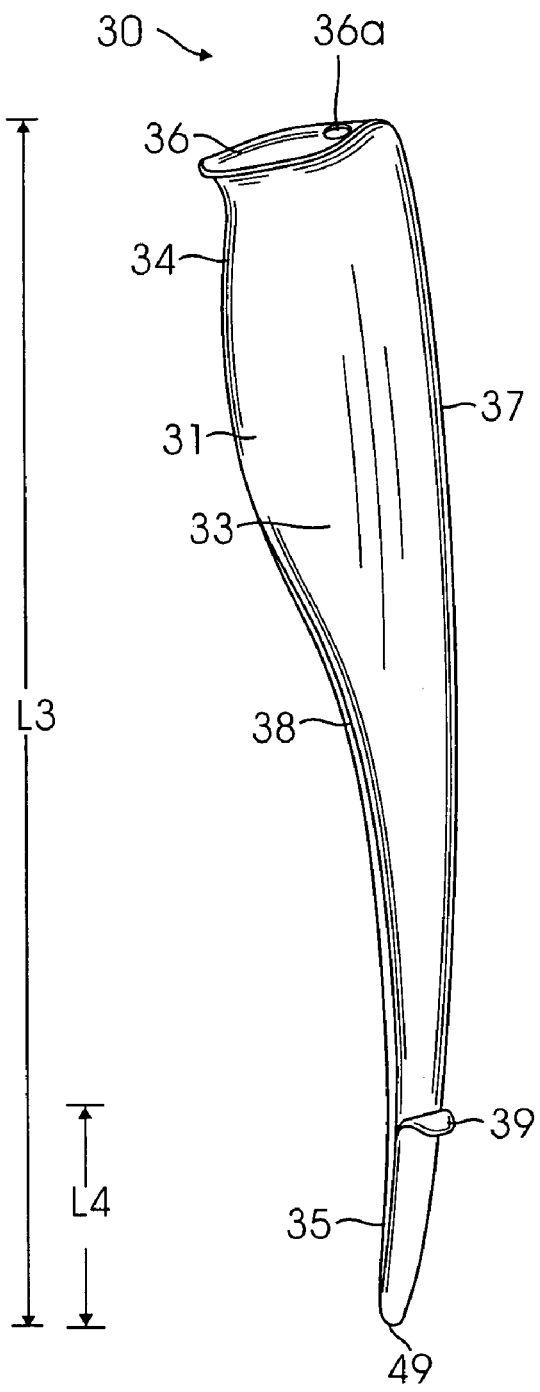
FIG. 9 is an elevational view of an outward face of a left-handed embodiment of the present invention.

Referring to FIG. 9, there is illustrated an elevational view of an outward face 33 of a left-handed embodiment of the present invention. While each device may take various configurations, the device for the left leg 30 comprises a preferably shaped helical, tapered blade 31, the width of which is curved into a convex-concave formation, which formation becomes more marked towards the shoulder area 34, made from a firm, polymer material, having a handle member 36 at or around the shoulder area 34, and on which resides a hook member 39 at or around the bottom area 35 on the convex face 33 of the blade 31. The bottom area 35 terminates in a bottom end 49 which preferably is generally rounded so that the blade will not damage objects being removed from the leg and foot.

The device 30 has a given length L3 which by way of example can be approximately 30 inches. In a preferred embodiment, hook member 39 emerges smoothly from the bottom area 35 as it rises into the curve of the hook member 39, the curvation of which is basally facing outward. It is also preferred that hook member 39 is located on or around the bottom area 35 in such a manner that there is a length L4 of bottom area 35 below hook member 39 sufficient to tuck between the article and the leg in the initial stage of article removal. The bottom area 35 terminates in a bottom end 39 which preferably is generally rounded so that the blade will not damage objects being removed from the leg and foot. Preferably, the length L4 of the curvature portion of the hook 39 can be between 10 percent and 25 percent of the total length L3.

Figure 10:
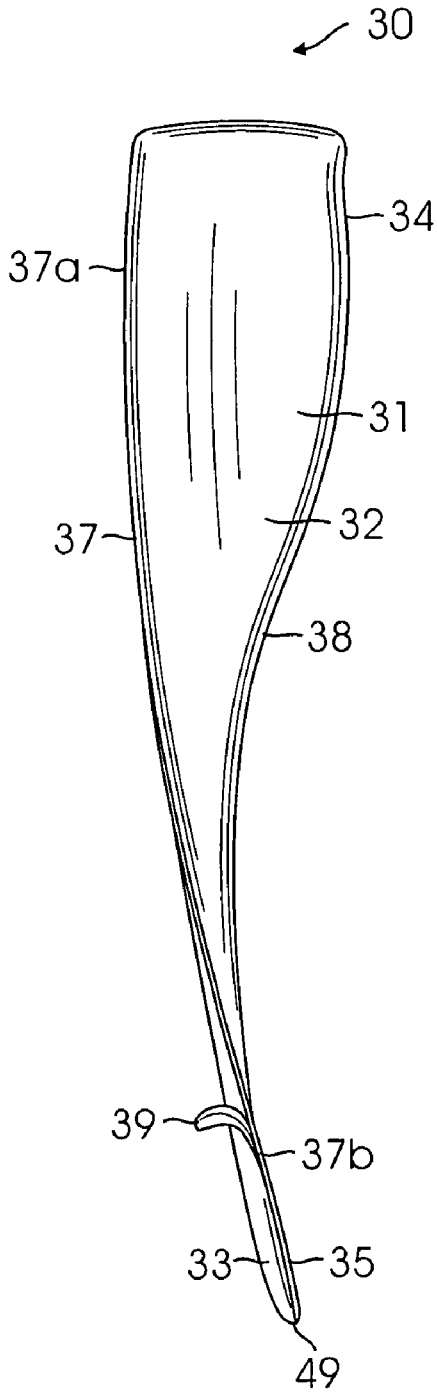
FIG. 10 is an elevational view of an inward face of a left-handed embodiment of the present invention.

The device has a leading edge 37 and a trailing edge 38. While the entire device for the left leg 30 has a generally left-hand, corkscrew or helical twist, the trailing edge 38 has more curvature than the leading edge 37. Further, the upper trailing edge 38*a* has more curvature than the lower trailing edge 38*b*. The twist for the leading edge 37 of the device for the left leg 30, as viewed in FIG. 10, follows the leading edge 37 along the side of the concave back 32 of the blade 31 from the shoulder area 34 to the bottom area 35. The shoulder area 34 is shown with the concave back 32 facing up. As the device for the left leg 30 makes the left hand twist, the bottom area 35 is turned such that the convex back 33 of the bottom area 35 is mostly shown. This view shows the gentle curve of the leading edge 37 from the upper leading edge 37*a* at the shoulder area 34 to the lower leading edge 37*b* at the bottom area 35.

Figure 11:
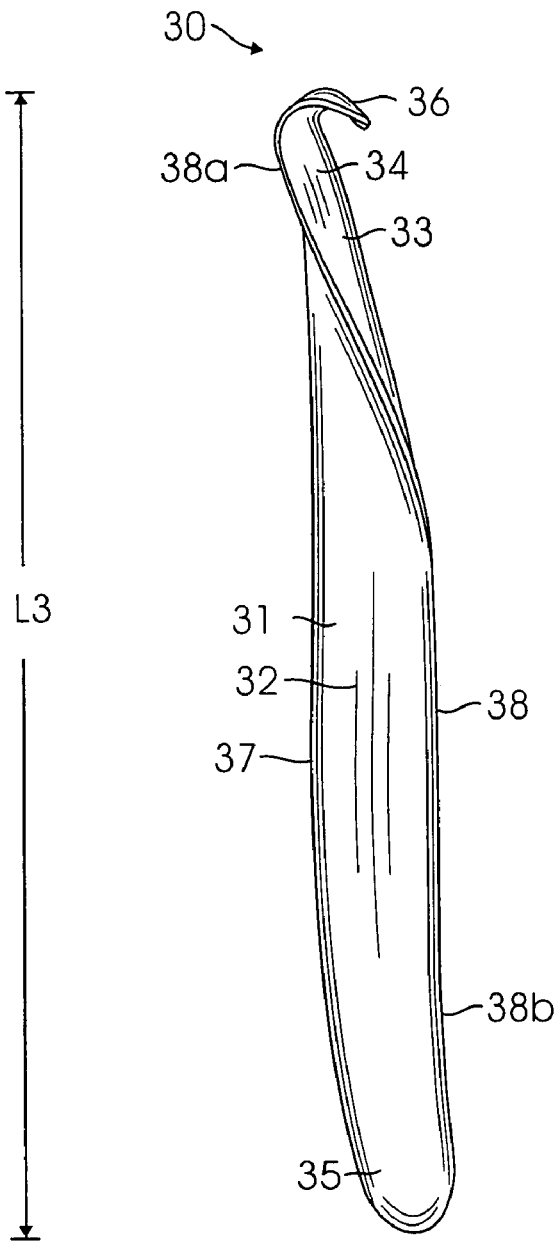
FIG. 11 is an elevational view of a left-handed embodiment of the present invention showing the bottom area fully from the inward side and the handle from the side and further illustrating the twist in the present invention from the inward side at the bottom area to the outward side at the shoulder area.

Referring to FIG. 11, the twist is illustrated on the device for the left leg 30 by showing the entire elevation of the bottom area 35 with the concave back 32 facing the viewer and highlighting the twist along the trailing edge 38. The upper trailing edge 38*a* of the device 30 at the shoulder area 34 is twisted such that part of the convex face 33 is also shown. It can be seen that the direction of the curve is left-handed and that the nature of the bend on the trailing edge 38 is rather sharp, which, as can be approximated from FIG. 3, has a torsion with rotation more than 90 degrees.

Figure 12:
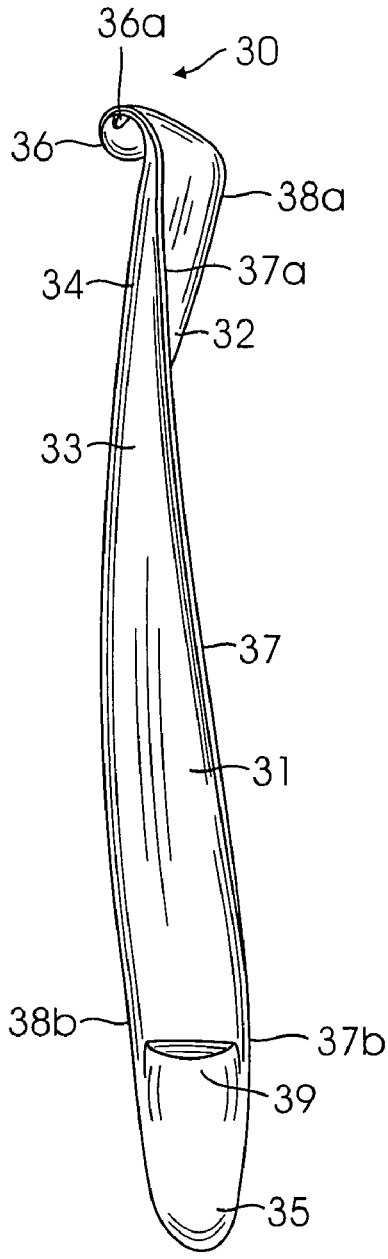
FIG. 12 is an elevational view of a left-handed embodiment of the present invention showing the bottom area fully from the outward side and the handle from the side opposite that shown in FIG. 11, and illustrating the twist in the present invention from the outward side at the bottom area to the inward side at the shoulder area.

Referring to FIG. 12, there is illustrated device for the left leg 30, the opposing view of that shown in FIG. 11. Here, the entire elevation of the bottom area 35 is shown in such a manner that the convex face 33 at the bottom area 35 is facing the viewer. The hook member 39 is located at the bottom area 35 of the blade 31. The curve along the leading edge 37 is highlighted. As the curve progresses from the bottom area 35 to the shoulder area 34, it shows the curve along the leading edge 37 from the lower leading edge 37*b* to the upper leading edge 37*a*. The twist along the leading edge 37 is enough to allow the concave back 32 to show at the shoulder area 34 of the blade 31. It can also be seen that the direction of the curve is left-handed and that the nature of the bend on the leading edge 37 is not very sharp and has a torsion with rotation approximately 90 degrees.

A comparison of the curves of the trailing edge 38 and the leading edge 37, as shown in FIG. 11 and FIG. 12 respectively, illustrates that the blade 31 has a curve that is generally left-handed. The translation of the leading edge 37 and the trailing edge 38 of the helical curve of the blade 31 is not symmetrical and, individually, neither edge is invariant, although the leading edge 37 is closer to being invariant than the trailing edge 38.

Figure 13:
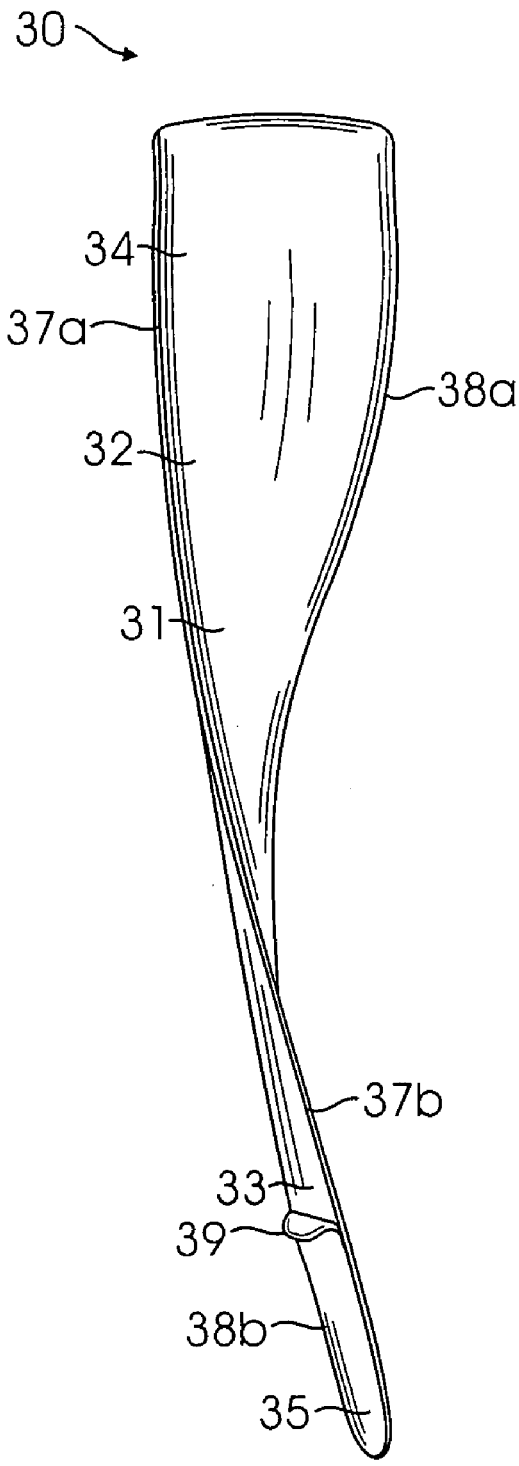
FIG. 13 is an elevational view of a left-handed embodiment of the present invention showing the shoulder area fully from the inward side and the bottom area from the outward side.
Figure 14:
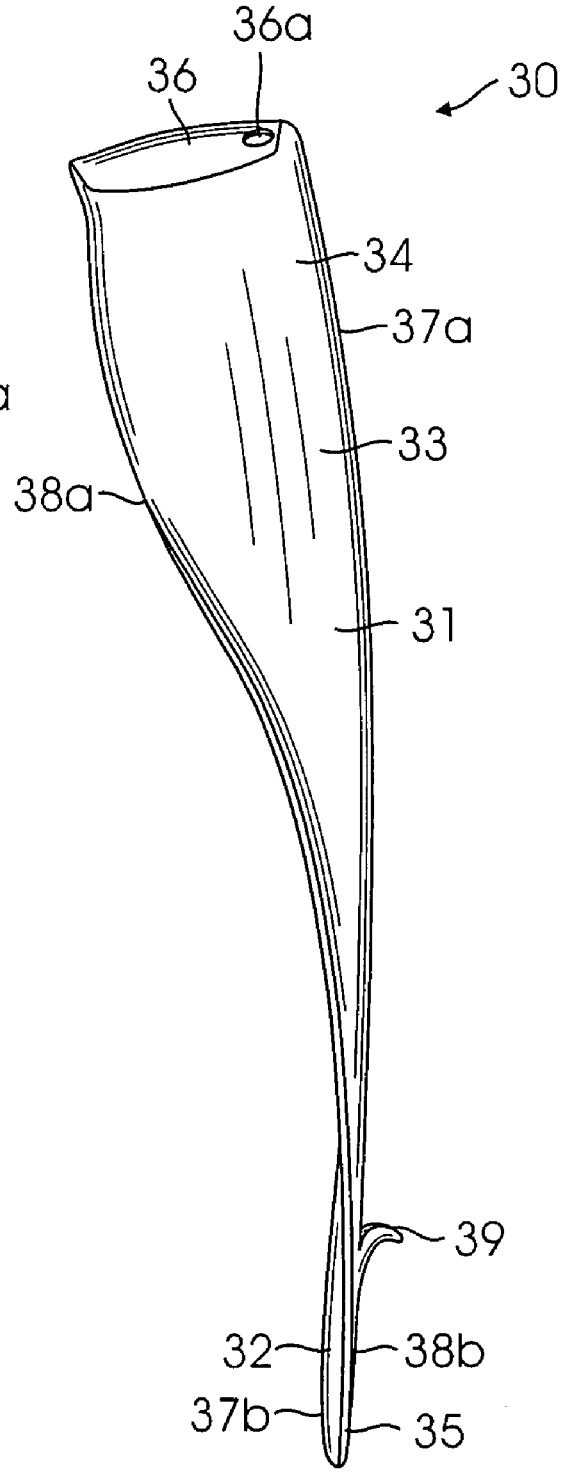
FIG. 14 is an elevational view of a left-handed embodiment of the present invention showing the shoulder fully from the outward side and the bottom area from the inward side.

Referring to FIG. 13 and FIG. 14, there is illustrated the device for the left leg 30 such that the shoulder area 34 is resting flat. FIG. 13 shows the device 30 with the shoulder area 34 of the concave back 32 fully facing the viewer, and FIG. 14 shows the device 30 with the shoulder area 34 of the convex face 33 fully facing the viewer. In FIG. 13, it can be seen that the lower leading edge 37*b* is turned approximately 90 degrees from the far end of the upper leading edge 37*a*. It can also be seen in FIG. 14, that the lower trailing edge 37*b* is turned more than 90 degrees from the far end of the upper trailing edge 37*a*.

Figure 15:
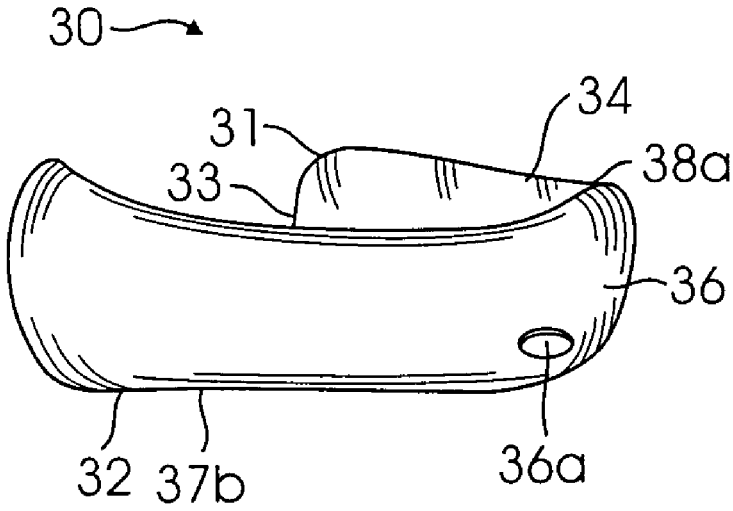
FIG. 15 is a top plan view of a left-handed embodiment of the present invention.

Referring to FIG. 15, there is illustrated the device for the left leg 30 from a top plan view showing the top of the handle 36 in the and the shoulder area 34 of the convex face 33 of the blade 31. The trailing edge 38 is shown rising from the upper right and curving over the handle member 36. The leading edge 37 is shown as it follows its course from the lower left of the handle member 36 to the bottom area 35 of the blade 31. FIG. 15 helps to illustrate the convexity of the face 33 and the concavity of the back 32 by showing the rise and fall of the convexity of the face 33 of the blade 31.

Figure 16:
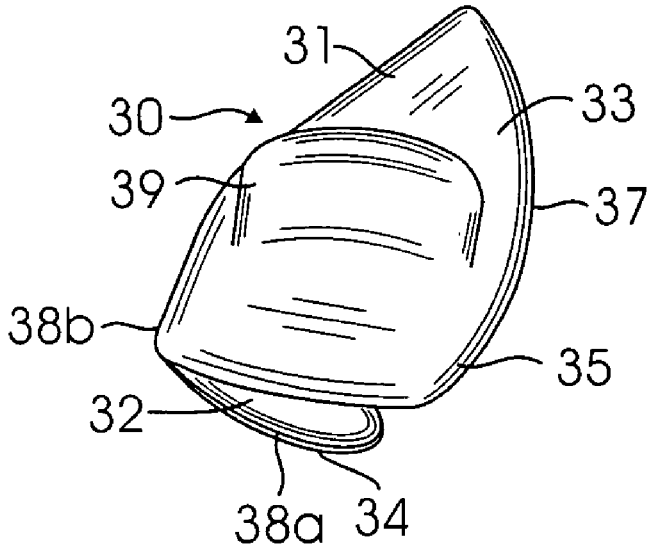
FIG. 16 is a bottom plan view of a left-handed embodiment of the present invention.

Referring to FIG. 16, there is illustrated a bottom plan view of the present invention looking directly into the curvation of the hook member 39 on the convex face 33 of the blade 31. To the right of the hook member 39, the leading edge 37 rises and curves from the bottom area 35 and disappears from sight around the shoulder area 34. The shoulder area 34 is seen from the concave back side 32 of the blade 31 from the side of the trailing edge 38 which, in FIG. 16, begins at and extends along the left side of the bottom area 35, disappears from view for a short stretch and is then shown as it continues to its conclusion at the upper end of the shoulder area 34.

As an optional feature, the device 30 can incorporate a means 36*a* by which the device can be retained on a surface such as a wall or door. By way of example, the device can be an opening 36*a* which can receive a cord or strap which can be hung on a nail or hook in a wall or door.

Figure 17:
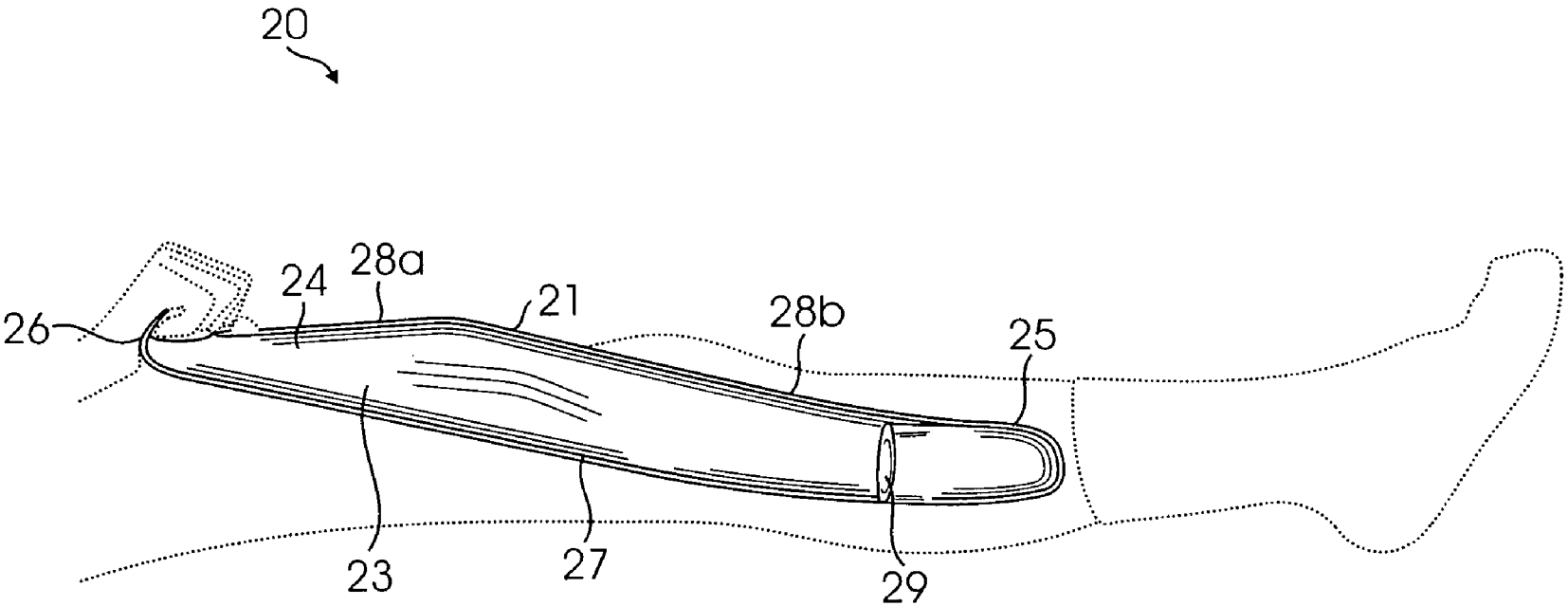
FIG. 17 is an elevational view illustrating the right-handed embodiment of the present invention in its operative condition of use in an initial position, shown in solid lines, and the user and sock in phantom lines.

Referring to FIG. 17, there is illustrated an elevational view showing the device for the right leg 20 in its operative condition of use in a preferred initial position, shown in solid lines, and the user and sock in phantom lines. The blade 21 is placed on the outer side of the leg, with the bottom area 25 and hook member 29 positioned such that they point in the direction of the foot. The handle member 26 and shoulder area 24 are resting on the thigh. The user can fully operate and manipulate the entire device with one hand.

Figure 18:
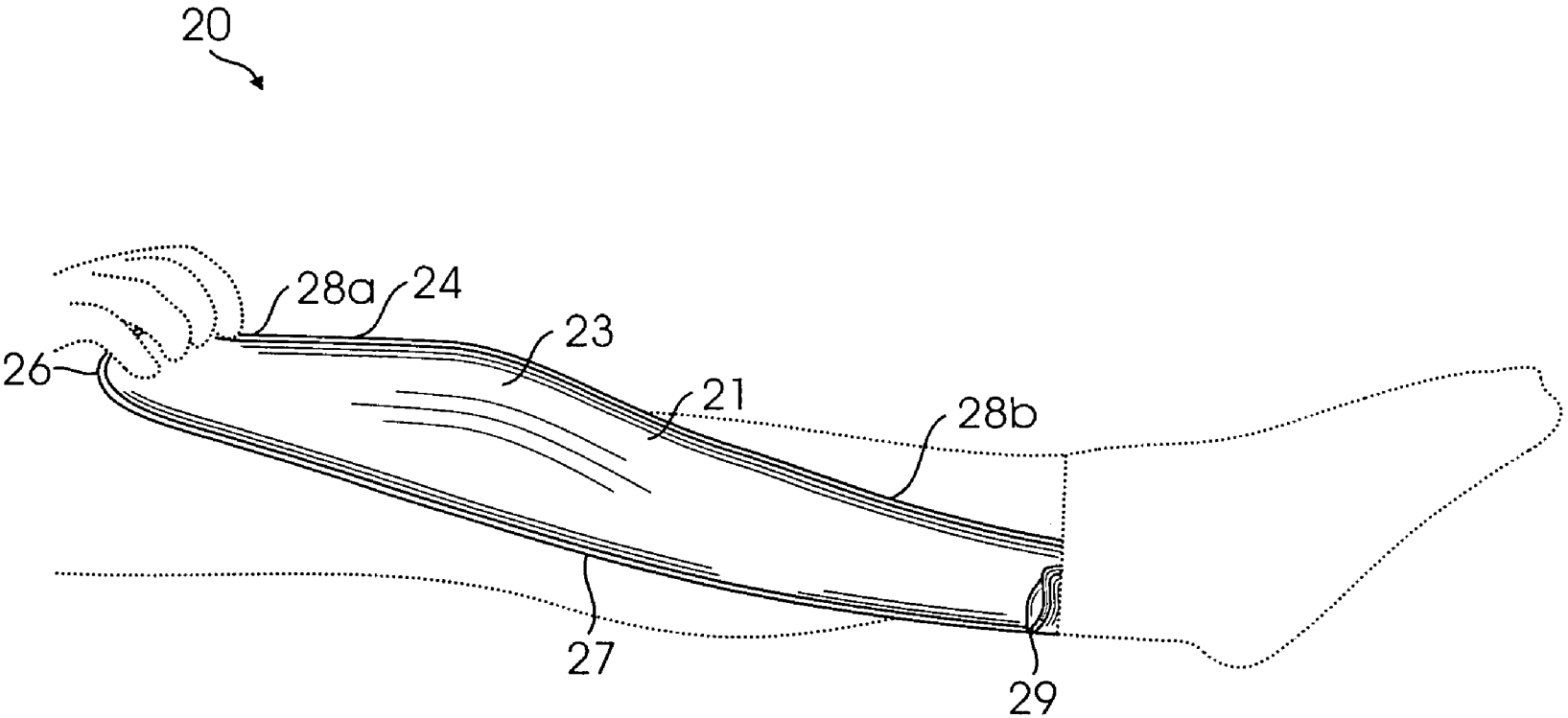
FIG. 18 is an elevational view illustrating the right-handed embodiment of the present invention in its operative condition of use in the beginning stage of sock removal showing the bottom area tucked between the leg and the sock and the hook member facing out and along the top of the sock.

Referring to FIG. 18, there is illustrated an elevational view showing the device for the right leg 20 in its operative condition of use in the beginning stage of sock removal. The user has pushed the device 20 causing the blade 21 to move down the leg. This movement of the device 20 allows the bottom area 25 to be tucked between the leg and the sock and further allows the hook member 29 to engage the top of the sock.

Figure 19:
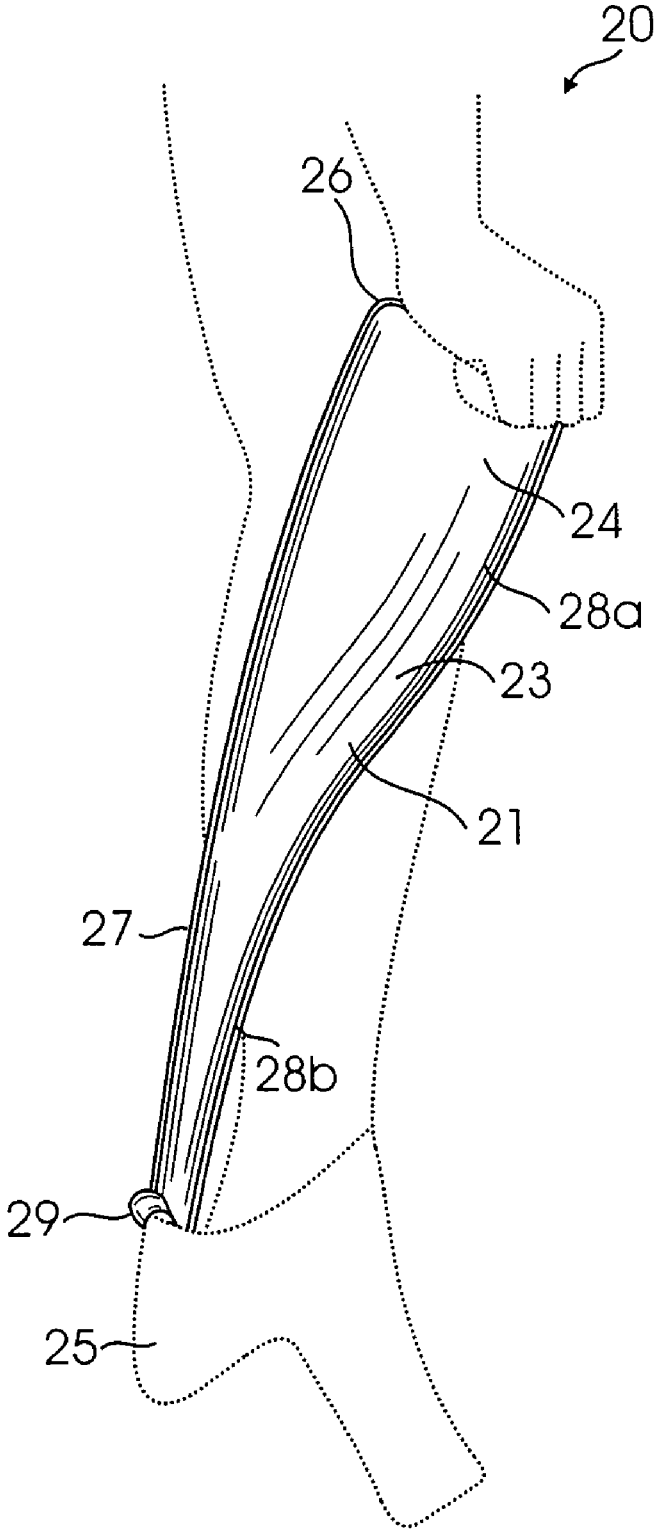
FIG. 19 is an elevational view illustrating the right-handed embodiment of the present invention in its operative condition of use in a progressive stage of sock removal showing hook member and the bottom area catching and removing sock as the device is pushed down from the handle.

Referring to FIG. 19, there is illustrated an elevational view showing the device for the right leg 20 in its operative condition of use in a progressive stage of removal. The user has used the handle member 26 to further progress the device 20 down the leg. Hook member 29 has fully engaged the sock and helps to roll the sock down. In cases where the sock is tightly fitting, the hook member 29 applies rigid pressure to the top of such articles. The hook member 29 has a curvature so as to prevent an article with high resistence to removal from slipping over the hook member 29 and hindering its removal. The bottom area 25 is fully within the sock and has progressed beyond the foot. The user may now complete the sock removal by pushing further on the handle 26 so that the blade 21 can continue progression down the leg and foot. The user may or may not choose to aid in the removal by pointing toes, or articulating ankle, knee, or hip.

Therefore, the present invention provides a new device which is an improvement over the prior art, combines previously uncombined features, fulfills an existing need, and satisfies a demand having a perpetual market which is not seasonal. The device is simple, convenient, durable, portable, marketable, novel, unique, lightweight, appealing, desirable, reliable, reusable, operable, interesting, and aesthetic. It is easy to use and inexpensive to manufacture and purchase. It is a quality product with an attractive design and shape. It provides a device necessary to remove all types of hosiery, both closely and tightly fitting.

Defined in detail, the present invention is an apparatus to aid in the removal of closely fitting articles on a leg and foot of a person, comprising: (a) a generally helical shaped tapered blade of a given length and made of a single piece of material having a shoulder area at a proximal end, a bottom area at a distal end, a leading edge and a trailing edge, the blade having a varying width tapering from the shoulder area to the bottom area which terminates in a generally rounded bottom edge, the blade being arcuate along a plane from the leading edge to the trailing edge wherein the blade has an outward face that is convex and a back that is concave; (b) a hook member integrally formed onto the outward face and extending away from the outward face and having a curvature extending toward the rounded bottom end, the hook member positioned at a given distance above the rounded bottom end; and (c) an integrally formed handle member located at an upper end of the shoulder area and curved in such a manner that the curvation is on the convex face and is facing the rounded bottom end; (d) whereby the blade is grasped in one hand by the handle and inserted between the article to be removed from a leg such that the curvature of the hook engages the uppermost portion of the article and a downward force on the blade enables the blade to push the article off the leg and foot and the rounded bottom end prevents the blade from damaging the article and the leg.

Defined broadly, the present invention is an apparatus to aid in the removal of closely fitting articles on a leg and foot of a person, comprising: (a) a generally helical shaped tapered blade of a given length having a shoulder area at a proximal end, a bottom area at a distal end, a leading edge and a trailing edge, the blade having a varying width tapering from the shoulder area to the bottom area which terminates in a bottom edge, the blade being arcuate along a plane from the leading edge to the trailing edge wherein the blade has an outward face that is convex and a back that is concave; (b) a hook member on the outward face and extending away from the outward face and having a curvature extending toward the bottom end, the hook member positioned at a given distance above the bottom end; and (c) a handle member located at an upper end of the shoulder area and curved in such a manner that the curvation is on the convex face and is facing the rounded bottom end; (d) whereby the blade is grasped in one hand by the handle and inserted between the article to be removed from a leg such that the curvature of the hook engages the uppermost portion of the article and a downward force on the blade enables the blade to push the article off the leg and foot without damaging the article and the leg.

Defined more broadly, the present invention is an apparatus to aid in the removal of closely fitting articles on a leg and foot comprising: (a) a helical blade made of a lightweight, rigid, firm substance, having a shoulder area at a proximal end, a bottom area at a distal end which terminates in a bottom edge, a leading edge, and a trailing edge, the blade being arcuate along the plane from the leading edge to the trailing edge so that the blade has a face that is convex and a back that is concave; (b) a means to engage the top of the article to be removed located on the convex face at a location on the bottom area at a given distance from the bottom edge and having a curvation that is facing the bottom edge; and (c) a handle member in the shoulder area.

Of course the present invention is not intended to be restricted to any particular form or arrangement, or any specific embodiment, or any specific use, disclosed herein, since the same may be modified in various particulars or relations without departing from the spirit or scope of the claimed invention herein above shown and described of which the apparatus or method shown is intended only for illustration and disclosure of an operative embodiment and not to show all of the various forms or modifications in which this invention might be embodied or operated.

What is claimed is:

1. An apparatus to aid in the removal of closely fitting articles on a leg and foot of a person, comprising:

a. a generally helical shaped tapered blade of a given length and made of a single piece of molded material having a shoulder area at a proximal end, a bottom area at a distal end, a leading edge and a trailing edge, the leading edge and the trailing edge have a different radius of curvature, the entire single piece blade having a varying width tapering from the shoulder area to the bottom area which terminates in a generally rounded bottom edge, the blade being helically arcuate along a plane from the leading edge to the trailing edge wherein the blade has an outward face that is convex and a back that is concave;

b. a hook member integrally formed onto the outward face and extending away from the outward face and having a curvature extending toward the rounded bottom end, the hook member positioned at a given distance above the rounded bottom end;

c. an integrally formed handle member located at an upper end of the shoulder area and curved in such a manner that the curvation is on the convex face and is facing the rounded bottom end; and d. the blade is grasped in one hand by the handle and inserted between the article to be removed from a leg such that the curvature of the hook engages the uppermost portion of the article and a downward force on the blade enables the blade to push the article off the leg and foot and the rounded bottom end prevents the blade from damaging the article and the leg.

2. The apparatus in accordance with claim 1 wherein the curvature of the back of the blade conforms to the curvature of the leg which retains the article to be removed.

3. The apparatus in accordance with claim 2 wherein the curvature of the back of the blade conforms to a shape of a left leg.

4. The apparatus in accordance with claim 2 wherein the curvature of the back of the blade conforms to a shape of a right leg.

5. The apparatus in accordance with claim 1 wherein the translation of the leading edge and the trailing edge are variant.

6. The apparatus in accordance with claim 1 wherein the leading edge is curved and the trailing edge is curved and the trailing edge has a greater curvation than the leading edge.

7. The apparatus in accordance with claim 1 wherein the apparatus is formed from a single piece of material from the group consisting of resin, plastic and polymer.

8. The apparatus in accordance with claim 1 wherein the curvature portion of the hook is located between the rounded bottom end and handle at a distance from the bottom end between 10 percent and 25 percent of the total length of the apparatus.

9. The apparatus in accordance with claim 1 wherein the curvature portion of the hook is located between the rounded bottom end and handle at a distance from the bottom end between 2 inches and 6 inches.

10. The apparatus in accordance with claim 1 further comprising means by which the apparatus can be retained on a surface.

11. An apparatus to aid in the removal of closely fitting articles on a leg and foot of a person, comprising:

a. a generally helical shaped tapered blade of a given length and made of a single piece of molded material having a shoulder area at a proximal end, a bottom area at a distal end, a leading edge and a trailing edge, the leading edge and the trailing edge have a different radius of curvature, the blade having a varying width tapering from the shoulder area to the bottom area which terminates in a bottom edge, the blade being arcuate along a plane from the leading edge to the trailing edge wherein the blade has an outward face that is convex and a back that is concave;

b. a hook member on the outward face and extending away from the outward face and having a curvature extending toward the bottom end, the hook member positioned at a given distance above the bottom end;

c. a handle member located at an upper end of the shoulder area and curved in such a manner that the curvation is on the convex face and is facing the rounded bottom end; and d. the blade is grasped in one hand by the handle and inserted between the article to be removed from a leg such that the curvature of the hook engages the uppermost portion of the article and a downward force on the blade enables the blade to push the article off the leg and foot without damaging the article and the leg.

12. The apparatus in accordance with claim 11 wherein the apparatus is made of a single piece of material, the handle is integrally formed with the blade and the hook is integrally formed with the blade.

13. The apparatus in accordance with claim 11 wherein the bottom end is generally rounded.

14. The apparatus in accordance with claim 11 wherein the curvature of the back of the blade conforms to the curvature of the leg which retains the article to be removed.

15. The apparatus in accordance with claim 14 wherein the curvature of the back of the blade conforms to a shape of a left leg.

16. The apparatus in accordance with claim 14 wherein the curvature of the back of the blade conforms to a shape of a right leg.

17. The apparatus in accordance with claim 11 wherein the translation of the leading edge and the trailing edge are variant.

18. The apparatus in accordance with claim 11 wherein the leading edge is curved and the trailing edge is curved and the trailing edge has a greater curvation than the leading edge.

19. The apparatus in accordance with claim 12 wherein the apparatus is formed from a single piece of material from the group consisting of resin, plastic and polymer.

20. The apparatus in accordance with claim 11 wherein the curvature portion of the hook is located between the bottom end and handle at a distance from the bottom end between 10 percent and 25 percent of the total length of the apparatus.

21. The apparatus in accordance with claim 11 wherein the curvature portion of the hook is located between the rounded bottom end and handle at a distance from the bottom end between 2 inches and 6 inches.

22. The apparatus in accordance with claim 11 further comprising means by which the apparatus can be retained on a surface.

23. An apparatus to aid in the removal of closely fitting articles on a leg and foot comprising:

a. a helical blade made of a lightweight, rigid, firm, single piece of molded material having a shoulder area at a proximal end, a bottom area at a distal end which terminates in a bottom edge, a leading edge, and a trailing edge, the leading edge and the trailing edge have a different radius of curvature, the blade being arcuate along the plane from the leading edge to the trailing edge so that the blade has a face that is convex and a back that is concave;

b. a means to engage the top of the article to be removed located on the convex face at a location on the bottom area at a given distance from the bottom edge and having a curvation that is facing the bottom edge; and c. a handle member in the shoulder area.

24. The apparatus to aid in the removal of closely fitting articles on the leg and foot in accordance with claim 23, wherein the handle member is formed from the upper portion of the shoulder area and curved in such a manner that the curvation is on the convex face and is distally facing.

25. The apparatus in accordance with claim 23 wherein the apparatus is formed from a single piece of material from the group consisting of resin, plastic and polymer.

26. The apparatus in accordance with claim 23 wherein the apparatus has a given length and the means to engage the top end of the article is a hook having a curvature portion located between the bottom end and handle at a distance from the bottom end between 10 percent and 25 percent of the total length of the apparatus.

27. The apparatus in accordance with claim 23 wherein the curvature portion of the hook is located between the rounded bottom end and handle at a distance from the bottom end between 2 inches and 6 inches.

28. The apparatus in accordance with claim 23 further comprising means by which the apparatus can be retained on a surface.

* * * * *